US006695657B2

(12) United States Patent
Hattori

(10) Patent No.: US 6,695,657 B2
(45) Date of Patent: Feb. 24, 2004

(54) ENGINE CONTROL FOR WATERCRAFT

(75) Inventor: Toshiyuki Hattori, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/085,012

(22) Filed: Feb. 26, 2002

(65) Prior Publication Data

US 2002/0155766 A1 Oct. 24, 2002

(30) Foreign Application Priority Data

Feb. 26, 2001 (JP) ..... 2001-050206

(51) Int. Cl.[7] ..... B63H 21/21
(52) U.S. Cl. ..... 440/84; 123/319
(58) Field of Search ..... 440/1, 87, 88, 440/84, 88 A; 123/319, 342, 344, 361

(56) References Cited

U.S. PATENT DOCUMENTS 4,281,996 A * 8/1981 Mouraret ..... 440/89
4,455,978 A 6/1984 Atago et al.
4,462,357 A 7/1984 Lockhart
4,566,415 A 1/1986 Iwai et al.
5,314,362 A 5/1994 Nagahora
5,318,466 A * 6/1994 Nagafusa ..... 440/86
5,941,188 A * 8/1999 Takashima ..... 114/55.5
6,015,319 A 1/2000 Tanaka
6,019,090 A 2/2000 Ozawa
2001/0036777 A1 * 11/2001 Iida et al. ..... 440/84

OTHER PUBLICATIONS

Co–pending U.S. patent application No.: 10/068,357, filed on Feb. 5, 2002. Title: Engine Control Unit for Water Vehicle; Inventor: Keiichi Hiki et al.
SeaDoo: 2000 Shop Manual vol. 2 for RX, RX DI, GRX DI. Pp. 05–01–1, 05–01–2. 05–02–2, 05–02–405–02–5.

* cited by examiner

*Primary Examiner*—Sherman Basinger
(74) *Attorney, Agent, or Firm*—Knobbe, Martens, Olson & Bear, LLP

(57) ABSTRACT

A watercraft includes an improved engine control system that eases watercraft operation. The watercraft includes a propulsion device, such as a jet propulsion unit, and an engine that powers the propulsion unit. The engine control system is configured to limit engine speed under certain conditions.

18 Claims, 11 Drawing Sheets

ENGINE CONTROL FOR WATERCRAFT

PRIORITY INFORMATION

This invention is based on and claims priority to Japanese Patent Application No. 2001-050206, filed Feb. 26, 2001, the entire contents of which are hereby expressly incorporated by reference.

BACKGROUND OF THE INVENTION

1. Field of the Invention

This invention relates to a control system for an engine of a watercraft.

2. Description of the Related Art

Personal watercraft have become very popular in recent years. This type of watercraft is quite sporting in nature and carries one or more riders. A hull of the personal watercraft commonly defines a rider's area above an engine compartment. An internal combustion engine powers a jet propulsion unit that propels the watercraft by discharging water rearward. The engine lies within the engine compartment in front of a tunnel, which is formed on an underside of the hull. The jet propulsion unit is placed within the tunnel and includes an impeller that is driven by the engine.

A deflector or steering nozzle is mounted on a rear end of the jet propulsion unit for steering the watercraft. A steering mast with a handlebar is linked with the deflector through a linkage. The steering mast extends upwardly in front of the rider's area. The rider remotely steers the watercraft using the handlebar.

The engine typically includes at least one throttle valve disposed in an air intake passage of the engine. The throttle valve regulates the amount of air supplied to the engine. Typically, as the amount of air increases, the engine output also increases. A throttle lever or control is attached to the handlebar and is linked with the throttle valve(s) usually through a throttle linkage and cable. The rider thus can control the throttle valve remotely by operating the throttle lever on the handlebar. In this manner, engine speed is typically controlled.

SUMMARY OF THE INVENTION

Disclosed is an engine control for a watercraft in which the watercraft has an engine having an air intake regulator that is movable through a first range of positions including an idle position and a fully open position. There is preferably a remotely located engine speed control operator movable between a first position and a second position that is coupled to the air intake regulator.

The engine may further have a controller coupled to the air intake regulator to at least selectively control the air intake regulator. The controller is preferably configured to provide a first mode of engine operation in which movement of the engine speed control operator between the first and second positions causes the air intake regulator to move through the first range of opening positions from the idle position to the fully open position. The controller may further be configured to provide at least a second mode of engine operation in which movement of the engine speed control operator causes the air intake regulator to move through a second range of opening positions that is less than the first range of opening positions.

The controller may be in communication with a modality selector that is selectable between at least two states corresponding to the at least two modes of engine operation provided by the controller. The modality selector may be configured to output a modality signal to the controller that is indicative of the desired mode of engine operation, and the controller correspondingly controls the engine in response to the signal received from the modality selector.

In accordance with another embodiment of the invention, a watercraft has an internal combustion engine that drives a jet propulsion unit. The watercraft further has an engine output control system to restrict the quantity of air that is taken in by the engine, and a switching means for switching the engine output control between an air-restricting state and an unrestricting state. When the output control is switched to the air-restricting state, the maximum output of the engine is limited.

In accordance with another aspect of the present invention, a method is provided for controlling the air intake of an internal combustion engine between at least a first and second operation mode. The engine preferably has an air intake regulator operable through a first range of motion and a remote actuator operable through a first range of motion corresponding with the first range of motion of the air intake regulator. Preferably, a change in a desired operation mode from the first operation mode to a second operation mode is detected and the air intake regulator is varied such that the air intake regulator is operable through a second range of motion that is less than the first range of motion.

Further features and advantages of the present invention will become apparent to those of skill in the art in view of the detailed description of preferred embodiments which follows, when considered together with the attached drawings and claims.

BRIEF DESCRIPTION OF THE DRAWINGS

These and other features, aspects, and advantages of the present invention will now be described with reference to the drawings of preferred embodiments, which are intended to illustrate and not limit the invention. The drawings comprise 11 figures.

DETAILED DESCRIPTION OF THE PREFERRED EMBODIMENTS OF THE INVENTION

Figure 1:
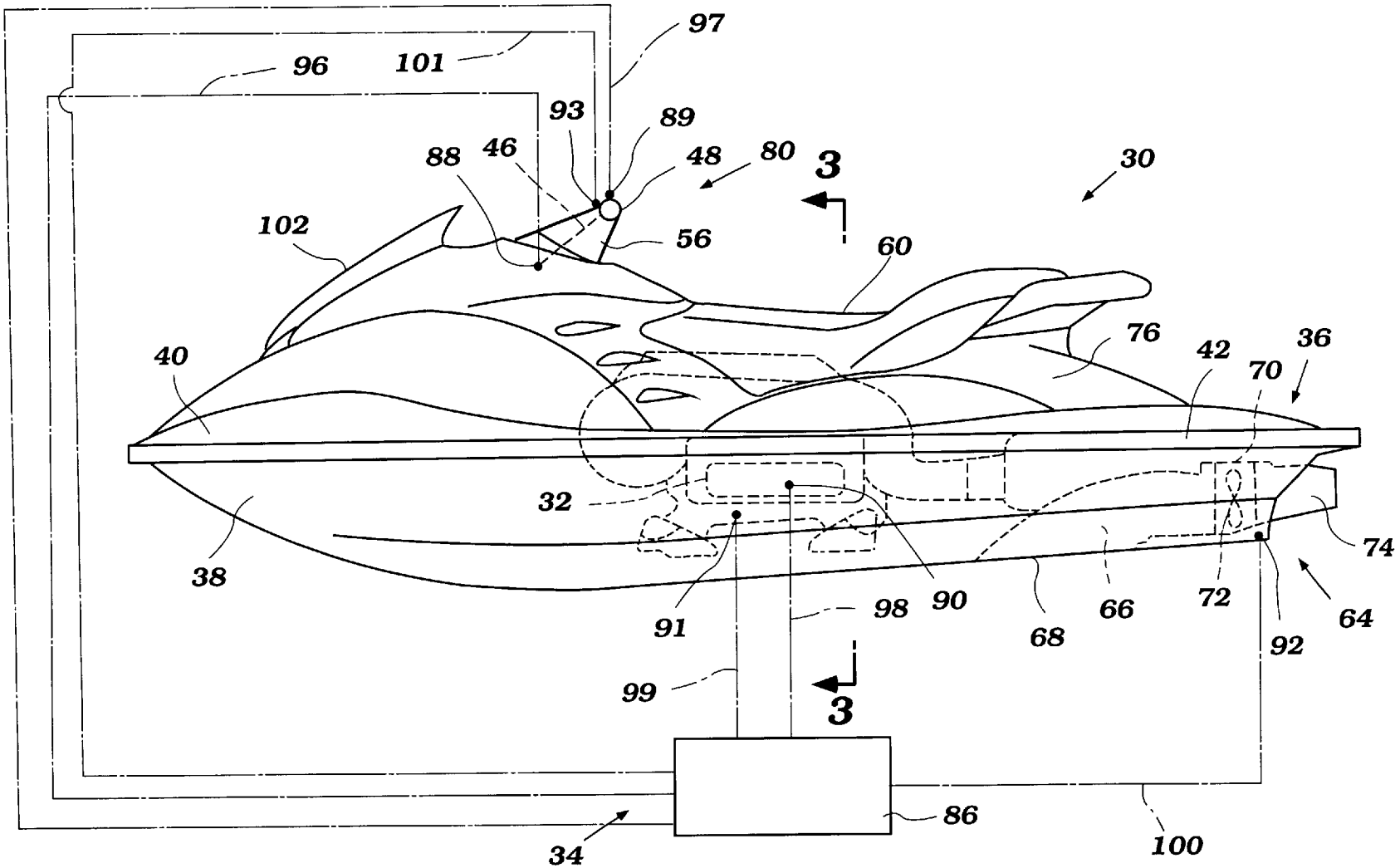
FIG. 1 is a side elevational view of a personal watercraft and schematically illustrates an engine control system configured in accordance with an embodiment of the present invention.

With primary reference to FIGS. 1 and 2, an overall configuration of a personal watercraft 30 will be described. The watercraft 30 employs an internal combustion engine 32 and an engine control system 34 configured in accordance with a preferred embodiment of the present invention. This engine control system 34 has particular utility with a personal watercraft and, thus, is described in the context of the personal watercraft. The control system, however, can be applied to other types of vehicles as well, such as, for example, small jet boats, all-terrain vehicles (ATVs), snowmobiles and the like.

The personal watercraft 30 includes a hull 36 generally formed with a lower hull section 38 and an upper hull section or deck 40. The lower hull section may include one or more inner liner sections to strengthen the hull or to provide mounting platforms for various internal components of the watercraft. Both the hull sections 38, 40 are made of, for example, a molded fiberglass reinforced resin or a sheet molding compound. The lower hull section 38 and the upper hull section 40 are coupled together to define an internal cavity. A gunnel or bulwark 42 defines an intersection of both the hull sections 38, 40.

Figure 10:
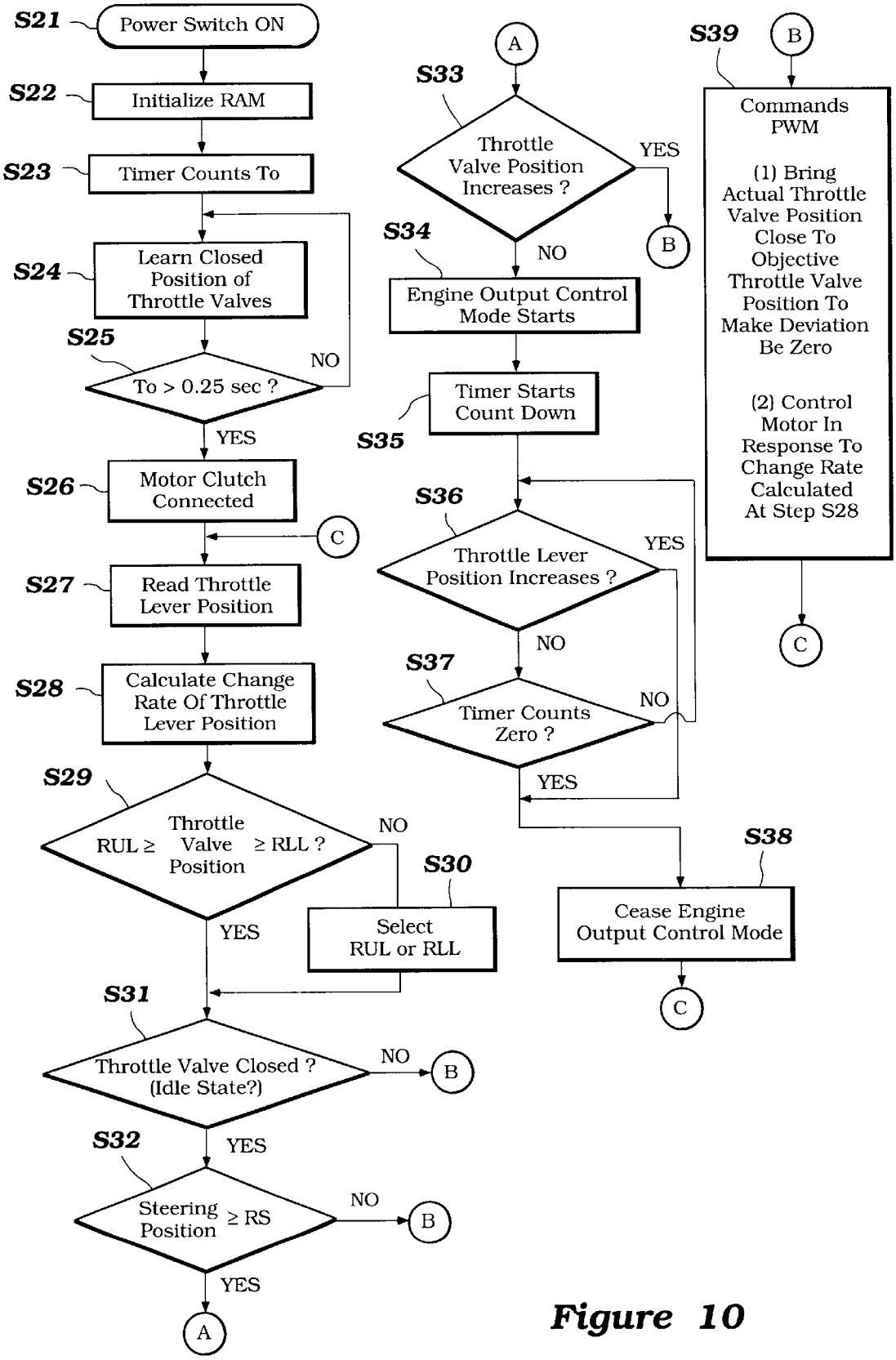
FIG. 10 is a control routine of an ECU of the engine control system shown in FIG. 9.

As seen in FIG. 1 and best seen in FIG. 10, a steering mast 46 extends generally upwardly almost atop the upper hull section 40 to support a handlebar 48. The handlebar 48 is provided primarily for a rider to control the steering mast 46 so that a thrust direction of the watercraft 30 is properly changed. The handlebar 48 also carries other control devices such as, for example, a throttle lever 52 (see FIG. 7A) for manually operating throttle valves 54 (FIGS. 3–5, and 8) of the engine 32. The throttle lever 52 is one type of a throttle operator that can be used with the present engine control system 32 and is remotely positioned relative to the engine 32. A rider can move the throttle lever 52 between a first, fully-released position, which corresponds to an idle position of the throttle valves, and a second, fully-depressed position, which corresponds to a fully open position of the throttle valves under some operating modes of the watercraft; however, in other operating modes of the engine, the throttle valves need not be fully opened when the throttle lever is fully-depressed, as will be described below. In the illustrated arrangement, the steering mast 46 is covered with a padded steering cover member 56.

Figure 2:
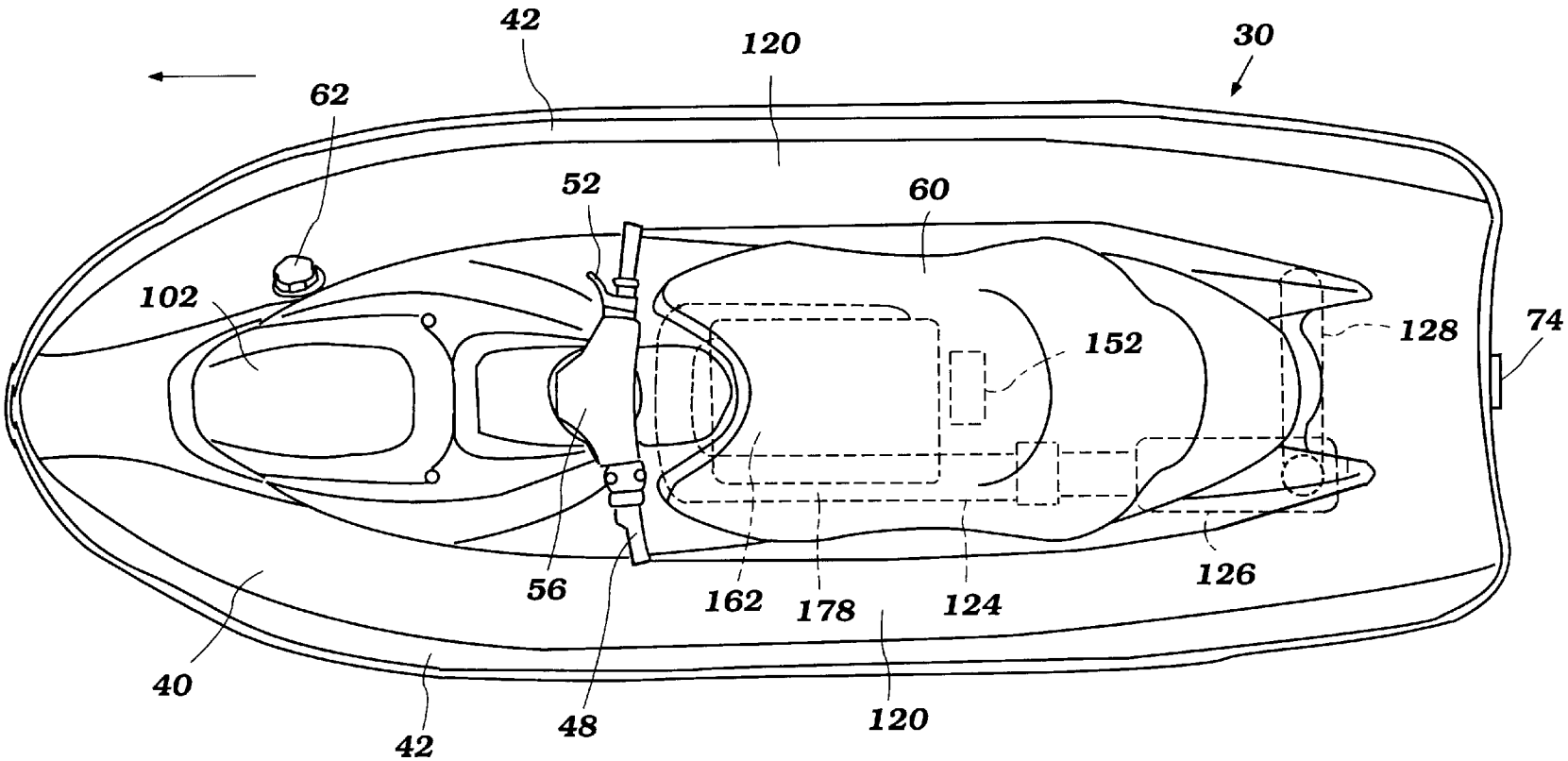
FIG. 2 illustrates a top plan view of a personal watercraft of FIG. 1 and illustrates some of the internal engine components in phantom.

Referring to FIGS. 1 and 2, a seat 60 extends longitudinally fore to aft along a centerline of the hull 36 at a location behind the steering mast 46. This area, in which the seat 60 is positioned, is a rider's area. The seat 60 has generally a saddle shape so that the rider can straddle it. Foot areas are defined on both sides of the seat 60 and at the top surface of the upper hull section 40. A cushion, which has a rigid backing and is supported by a pedestal section 76 of the upper hull section 40, forms part of the seat 60. The pedestal forms the other portion of the seat. The seat cushion is detachably attached to the pedestal of the upper hull section 40. An access opening is defined on the top surface of the pedestal, under the seat cushion, through which the rider can access an engine compartment (196 of FIG. 3) defined in an internal cavity formed between the lower and upper hull sections 38, 40. The engine 32 is placed in the engine compartment 196. The engine compartment 196 may be an area within the internal cavity or may be divided from one or more other areas of the internal cavity by one or more bulkheads.

A fuel tank is placed in the internal cavity under the upper hull section 40 and preferably in front of the engine compartment 196. The fuel tank is coupled with a fuel inlet port positioned at a top surface of the upper hull section 40 through a filler duct. A closure cap 62 closes the fuel inlet port. The fore section of the upper hull 40 includes a hatch cover 102 detachably affixed, such as, for example, by hinges, to provide access to an internal cavity which may house the fuel tank.

At least a pair of air ducts or ventilation ducts is provided on both sides of the upper hull section 40 so that the ambient air can enter the internal cavity through the ducts. Except for the air ducts, the engine compartment 196 is substantially sealed so as to protect the engine 32 and a fuel supply system (including the fuel tank) from water.

A jet propulsion system 64 propels the watercraft 30. The jet propulsion system 64 includes a tunnel 66 formed on the underside of the lower hull section 38. In some hull designs, the tunnel is isolated from the engine compartment 196 by a bulkhead. The tunnel 66 has a downward facing inlet port 68 opening toward the body of water. A jet pump unit 70 is disposed within a portion of the tunnel 66 and communicates with the inlet port 68. An impeller 72 is rotatably supported within the housing of the unit 70. An impeller shaft extends forwardly from the impeller 72 and is coupled with a crankshaft of the engine 32 so as to be driven by the crankshaft. This may be done directly or through a gear train. The rear end of the unit 70 includes a discharge nozzle 74. A cable connects the discharge nozzle 74 with the steering mast 46 so that the rider can rotate the discharge nozzle 74 about the steering axis. A watercraft propulsion system 64 may optionally include a deflector positioned aft of the discharge nozzle and pivotable about a vertical steering access to provide additional steering control. A steering mechanism 80 for the watercraft thus preferably comprises the steering mast 46, the handlebar 48, the cable and the nozzle 74 or deflector.

When the crankshaft of the engine 32 drives the impeller shaft and hence the impeller 72 rotates, water is drawn from the surrounding body of water through the inlet port 68. The pressure generated in the jet pump unit 70 by the impeller 72 produces a jet of water that is discharged through the discharge nozzle 74. The water jet produces thrust to propel the watercraft 30. Maneuvering of the nozzle 74 changes the direction of the water jet, thus providing forces having both lateral and longitudinal vectors to affect the heading of the watercraft 30. The rider thus can turn the watercraft 30 in either a right or a left direction by operating the steering mechanism 80.

As schematically shown in FIG. 1, the engine control system 34 preferably includes an ECU (electronic control unit) or control device 86, a steering position sensor 88, a throttle lever position sensor 89, a throttle position sensor 90, an engine rpm sensor 91, a watercraft velocity sensor 92, and an engine operating mode sensor 93. However, as will be apparent, the engine control system need not include all of these sensors for certain control modes, such as, for example, limiting engine speed. The ECU 86 is preferably mounted on the engine 32 or disposed in proximity to the engine 32. The steering position sensor 88 is preferably positioned adjacent to the steering mast 46 so as to sense an angle of the steering mast 46 when the rider operates it. The throttle lever position sensor 89 is positioned at the throttle lever 52 or is located along the cable and/or linkage that connects the throttle lever 52 to the throttle valve 54. For example, the throttle lever position sensor 89 could be attached to the throttle pulley 226 (see FIG. 5), which is connected to the throttle lever 52 by a cable 118 in the illustrated embodiment. The throttle position sensor 90 is preferably affixed at one end of throttle valve shafts 94 (FIGS. 4–5 and 12) so as to sense a position of the throttle valves 54. The engine rpm sensor 91 may be located at an end of the crankshaft or along the impeller shaft. The watercraft velocity sensor 92 is preferably located at a rear bottom portion of the watercraft 30, which is submerged during normal running conditions of the watercraft 30. The respective sensors 88, 89, 90, 91, 92, and 93 are connected to the ECU 86 through signal lines 96, 97, 98, 99, 100, and 101 respectively. Of course, the signals can be sent through hard-wired connections, emitter and detector pairs, infrared radiation, radio waves or the like. The type of signal and the type of connection can be varied between sensors or the same type can be used with all sensors.

With specific reference to FIG. 2, the layout of the engine and exhaust system is illustrated. The engine 32 is housed within a cavity formed between the lower and upper hull sections 38, 40. Generally, this cavity is formed under the seat 60, which is removably detached to provide access to the cavity, but can be located in other locations, such as, for example, under the cover member 56 or in the bow, or above the jet propulsion unit. On either side of the seat, portions of the upper hull section 40 define relatively flat foot areas 120 for a rider's feet to allow additional stability of the rider upon the watercraft.

Generally disposed on top of the engine is a plenum chamber 122 that contains a volume of air for induction into the engine 32.

The exhaust gasses are routed through an exhaust pipe 124 that is connected at a downstream end to a water-lock 126. The water-lock 126, in turn, is connected to a discharge pipe 128. During operation of the engine 32, exhaust gasses flow through the exhaust pipe 124, pass through the water-lock 126, and exit the watercraft through the discharge pipe 128. The water-lock is configured so that water is inhibited from entering the exhaust pipe 124 from the discharge pipe 128. In this way, the engine is in communication with the surrounding environment to discharge exhaust gasses, yet is generally protected from water ingress.

The engine preferably operates on a 4-stroke combustion principle; however, other combustion principles are contemplated herein, such as 2-stroke, crankcase compression, diesel, wankel, and other rotary types. Furthermore, 4-stroke engines having other types of induction systems are also contemplated herein, such as "throttleless" engines that omit throttle valves altogether by delegating the air regulation to the intake valves alone. For example, these types of engines may provide a displaceable intake cam shaft to allow a regulated amount of air into the combustion chamber even when the valve is substantially closed. Other type of air induction systems may omit an intake and/or exhaust cam shafts and provide one or more solenoids or a hydraulic or pneumatic system to drive the respective intake and exhaust valves. The disclosed engine configurations are illustrative of one type of combustion engine with which the present engine control system can be used and should not be limiting to the scope of the appended claims.

Figure 3:
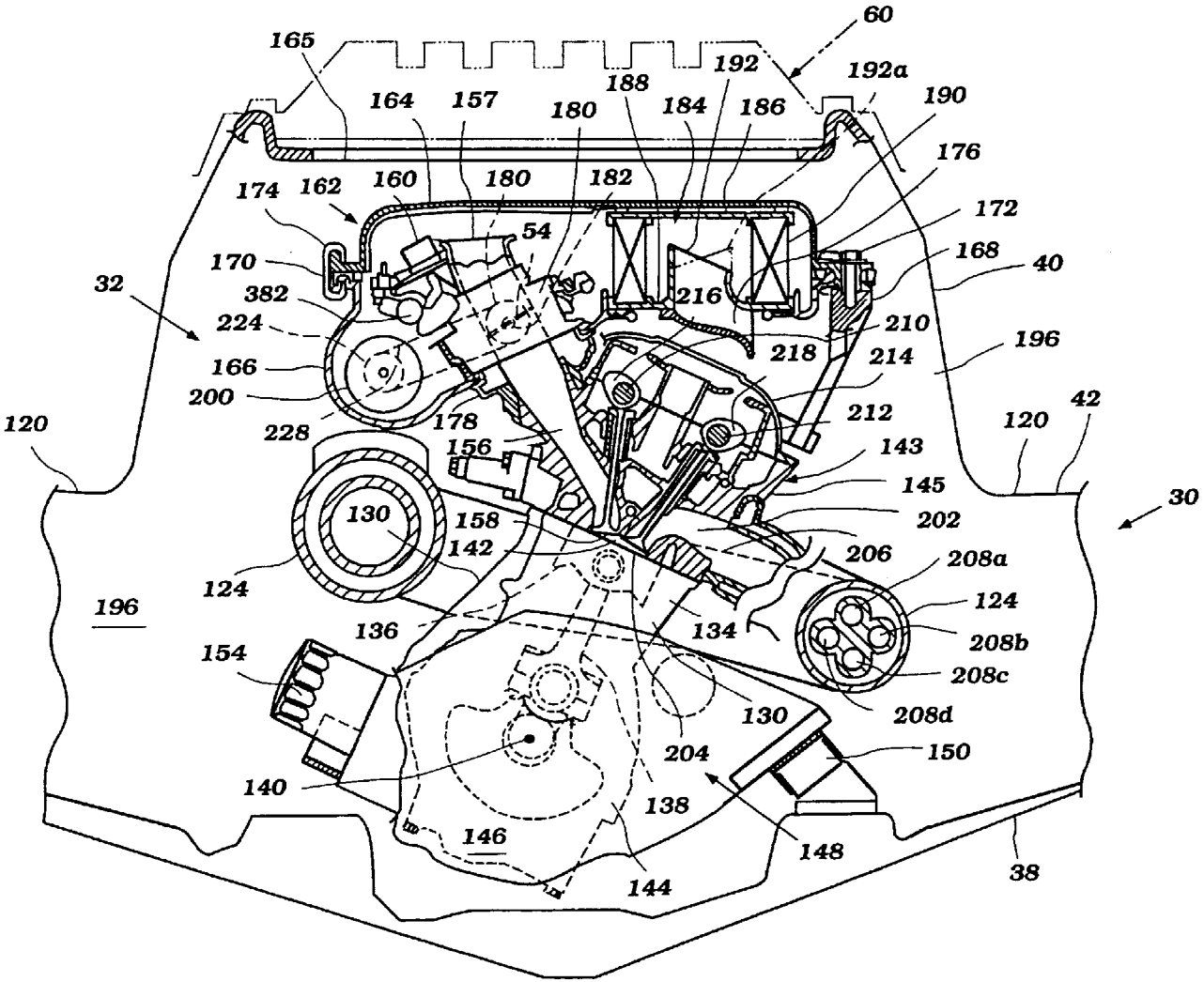
FIG. 3 is a cross-sectional view of the watercraft and engine of FIG. 1 taken along line 3—3, including a schematic profile of a hull of the watercraft and a sectional view of the engine's induction and exhaust systems and cylinder head.

With reference to FIG. 3, an engine 32 includes a cylinder block 130 that defines at least one cylinder bore 134. Preferably, the cylinder block includes cooling fins 145 to help conduct the engine generated heat away from the engine. The illustrated engine includes four cylinder bores 134 each spaced apart fore to aft, thus defining an in-line four cylinder engine. The axes of the cylinder bores 134 also are skewed relative to a vertical plane such that the engine is inclined. This engine layout is merely exemplary and other engine types, number of cylinders, and cylinder configurations are possible.

Each cylinder bore 134 supports a reciprocating piston 136 therein which is rotatably connected to a connecting rod 138 at one end. The opposing end of each connecting rod 138 is rotatably connected to a crankshaft 140, which is journaled with the cylinder block 130 for rotational movement. Thus, the reciprocating pistons 136 impart a rotational displacement to the crankshaft 140.

A cylinder head 143 is integrally connected with the cylinder block 130 to create a closed combustion chamber 142 in conjunction with the cylinder bores 134 and the pistons 136. A crankcase 144 is affixed to the lower portion of the cylinder block 130 and defines a crankcase chamber 146. The cylinder block 130, the cylinder head 143, and the crankcase 144 together define an engine body 148. The engine body 148 is preferably made of an aluminum based alloy. In the illustrated embodiment, the engine body 148 is oriented in the engine compartment 196 so as to position the crankshaft 140 in a generally fore to aft orientation. Other orientations of the engine body 148, of course, are possible such as having a transversely or vertically oriented crankshaft.

Engine mounts 150 extend from both sides of the engine body 148 and preferably have resilient portions to attenuate the vibration from the engine 32. The resilient portions may be made from any of a wide variety of materials known to have dampening properties, such as, without limitation, rubber. The engine 32 is preferably mounted to a hull liner that forms an inner part of the lower hull 38.

In the illustrated embodiment of FIG. 3, the intake box 162 comprises an upper housing 164 and a lower housing 166 coupled together to define an enclosed space, or plenum chamber 160. The upper and lower housings 164, 166 are preferably made of plastic or a synthetic resin, although they may be formed of metal or other material. The upper housing 164 is generally the upper most feature of the engine and is visible upon removal of the seat 60 and opening of an access hatch. The upper housing 164 may optionally be configured with surface features on its exposed surface designed to direct water away from the engine and to inhibit pooling of water on or around the housing. Such surface features may be in the form of channels configured to direct water away from sensitive engine areas.

The lower housing is coupled with the engine body 148, and in one embodiment, this is accomplished by providing a plurality of stays 168 extending generally upwardly from the engine body 148 and provide a relatively horizontal surface for interfacing with a surface of a flange 170 of the upper housing 164. The stays 168 and flanges 170 are securely fastened together, such as, for example, by a bolt 172 and optionally a nut. In addition to the fasteners previously described, one or more clips, such as C-clip 174 may be provided to engage the upper housing 164 with the lower housing 166.

Typically, an engine may be described in terms of its various systems, such as a lubrication system, air induction system, fuel supply system, exhaust system, and a propulsion system, each which will be discussed in later detail.

Figure 4:
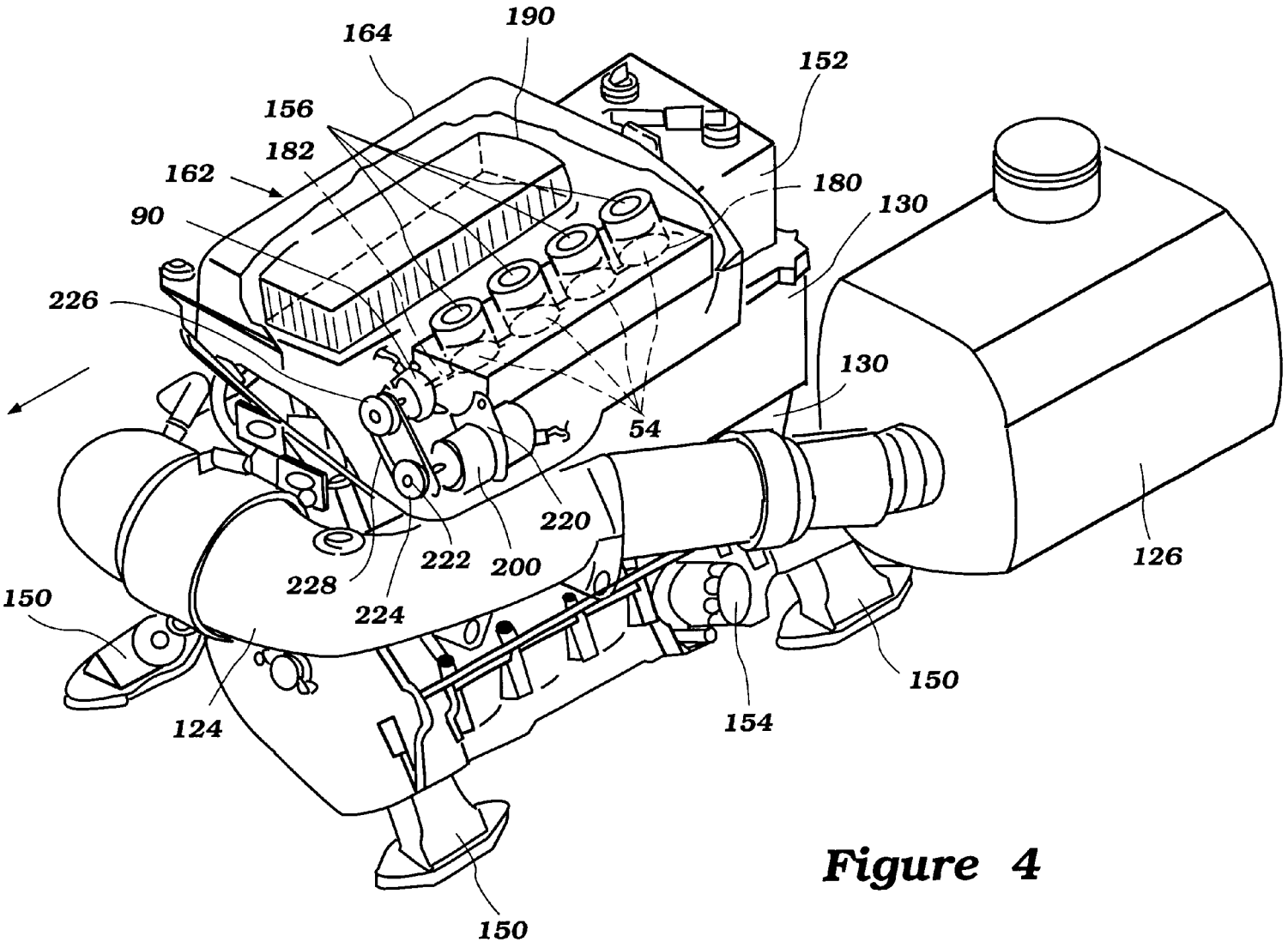
FIG. 4 is an isometric view of the watercraft engine of FIG. 3 shown in isolation, and illustrates many of the engine's general features.

With continued reference to FIG. 3, and supplemental reference to FIG. 4, the engine 32 is lubricated with oil housed in an oil tank 152 mounted aft of the engine. Oil from the oil tank 152 circulates throughout the engine 32 during operation to lubricate and cool the frictional components. The circulating oil passes through an oil filter 154 mounted to a side of the engine 32 to remove any contaminants that may circulate through and harm the engine 32.

The engine 32 preferably includes an air induction system for drawing air into the combustion chamber(s) 142 through intake port(s) 156. For simplicity, this description refers to a single intake port 156, combustion chamber 142, cylinder bore 134, and piston 136; however, it should be understood that a plurality cylinder/piston assemblies may be present, and a description of just one cylinder/piston assembly should in no way be limiting.

The intake port 156 is in selective communication with the combustion chamber 142 via one or more intake valves 158. The intake port 156 additionally has an inlet end 157 that allows communication with a plenum chamber 160 defined by an air intake box 162. The plenum chamber 160 serves to reduce any kinetic momentum and turbulence from the intake air before it is drawn in through the intake system and into the combustion chamber 142, and further acts as an intake silencer. The intake box 162 is preferably as large as possible, and thus, in the illustrated embodiment, the intake box 162 is generally rectangularly shaped to occupy the volume between the top of the engine and the bottom of the seat 60. Other configurations are possible without adversely affecting the engine's operation.

With continued reference to FIG. 3, the lower housing 166 defines an air inlet duct 176 for drawing air from the engine compartment 196 into the plenum chamber 160, and at least one outlet aperture 178. There is preferably an air filter assembly disposed within the described air flow path to remove any contaminants from entering the engine 32. Accordingly, an air filter assembly 184 comprises an upper plate 186, one or more lower plates 188, and at least one air filter 190. In the illustrated embodiment of FIG. 3, the air inlet duct(s) 176 terminates in the air filter assembly 184, thus delivering air into the plenum chamber 160 by way of the air filter assembly 184. It is preferable that the air filter(s) 190 comprise oil resistant and water repellant elements. Moreover, the air inlet ducts 176 may be oriented to direct the incoming air a certain direction, such as away from, or toward, the throttle body 180 (as shown by 192 and 192*a* in phantom). By directing the incoming air, any water or oil vapor or mist can be preferentially deposited on the walls of the filter assembly rather than be allowed to continue toward the throttle body 180. Of course, other arrangements are possible.

It is preferable that the air inlet ducts 176 are positioned away from the sides of the engine compartment 196, and more preferable that they are positioned toward the upper portion of the engine compartment 196 to reduce the risks of water, or other foreign substances, entering the air intake system. The air inlet ducts 176 may further be tuned to attenuate noise caused by the air intake system and thus act to muffle intake noise.

At least one throttle valve 54 is disposed within each air intake passage 156 and regulates the amount of air flowing therethrough to the engine 32. As the piston moves in a downwardly direction, i.e. away from the combustion chamber, the increase in volume within the cylinder bore 134 creates a pressure drop which, in turn, draws air from the plenum chamber 160, through the throttle valve 54, and through the intake passage 156 into the combustion chamber.

In the illustrated embodiment, a throttle body 180 contains a throttle valve 54. The throttle valve in this embodiment is a butterfly valve; however, other types of valves can be used as well. Each throttle valve 54 is fastened to a common throttle valve shaft 182 assembly, which is journaled for rotational movement. Accordingly, the throttle valves 54, which the throttle valve shaft link together, are constrained to move in unison. The rotational displacement of the throttle valve shaft assembly 182 primarily is rider controlled by actuating the throttle lever 52, which generally is mounted to the handlebar 48.

The throttle lever 52 may be coupled to the valve shaft 182 by any of a number of means, such as, for example, mechanical couplings or electrical connections. In one embodiment, the throttle lever 52 is directly coupled to the throttle valve shaft assembly 182 by a throttle cable (for example, cable 118 of FIG. 11, that is connected to a pulley 226 mounted to the throttle valve shaft 182). Another embodiment incorporates an electric motor 200 that is actuated by the throttle lever 52, which will be discussed in greater detail in relation to FIGS. 6 and 8.

The engine 32 also includes a fuel supply system as illustrated in FIG. 3. The fuel supply system comprises a fuel tank (not shown) and fuel injectors (not shown) that are affixed to a fuel rail (not shown) and are mounted on the throttle body 180. The fuel rail extends generally horizontally in the longitudinal direction. A fuel inlet port (not sown) is defined at a forward portion of the lower housing 166 so that the fuel rail is coupled with an external fuel passage. Because the throttle body 180 is disposed within the plenum chamber 160, the fuel injectors are also preferably positioned within the plenum chamber 160. However, other types of fuel injectors may be used that are not disposed within the plenum chamber 160, such as, for example, direct fuel injectors and induction passage fuel injectors connected to scavenge passages of traditional two-cycle engines. Each fuel injector preferably has an injection nozzle directed toward an associated intake port 156.

The fuel injectors are timed such that a measured volume of spray is injected into the combustion chamber 142 along with a quantity of air drawn from the plenum chamber 160. The resulting air-fuel mixture is compressed by the piston 136 and then ignited. The resulting combustion reaction generates the power that propels the watercraft 30.

With reference to FIGS. 2–4, an exhaust system is described that functions to expel the exhaust gasses created during the combustion reaction. In the illustrated embodiment, the exhaust system includes at least one exhaust port 202 for each combustion chamber 142. The exhaust ports 202 are defined as passages within the cylinder head 143 and are in selective communication with an associated combustion chamber 142, separated only by exhaust valves 204.

The exhaust system further includes an exhaust manifold 206, which may comprise a single or multiple individual manifolds. In one embodiment, there are two exhaust manifolds 206, each one serving two exhaust ports 202. In the illustrated embodiment, one exhaust manifold 206 houses two exhaust conduits connected to the exhaust ports on the starboard side of the engine, while a second exhaust manifold 206 houses two exhaust conduits connected to the exhaust ports on the port side of the engine. The individual exhaust manifolds 206 converge downstream into a single exhaust pipe 124 housing a plurality of exhaust conduits 208*a*, 208*b*, 208*c*, and 208*d*. The exhaust conduits 208*a–d* carry the exhaust gasses through the exhaust pipe 124. A cooling jacket surrounds the conduits 208*a–d* in the exhaust pipe.

With specific reference to FIG. 4, the exhaust pipe 124 is coupled to a water-lock 126 generally located toward the aft of the watercraft. A discharge pipe (not shown) connects to the top of the water-lock 126, extends upward and then downward, eventually terminating at the stern of the watercraft along a lower portion of the watercraft that is generally submerged under at least some operating conditions. The configuration of the discharge pipe and the water-lock 126 serve to inhibit water from entering the engine through the exhaust system.

With reference back to FIG. 3, an exhaust valve 204 that is disposed within the exhaust port 202 selectively opens the corresponding combustion chamber to the exhaust system. The exhaust valve 204, and similarly, the intake valve 158, preferably is actuated by a cam mechanism disposed generally above the valve. In the illustrated embodiment of FIG. 3, a double overhead camshaft drive is employed. That is, an intake camshaft 210 actuates the intake valves 158 and an exhaust camshaft 212 separately actuates the exhaust valves 204.

Both the intake camshaft 210 and the exhaust camshaft 212 are journaled within the cylinder head 143 for rotational movement. Camshaft caps, which hold the camshafts 210, 212, are affixed to he cylinder head 143. A cylinder head cover 214 extends over the camshafts 210, 212 and defines a camshaft chamber.

The intake camshaft 210 carries a plurality of cams, each one corresponding to an intake valve 158. Likewise, the exhaust camshaft 212 carries a plurality of cams each corresponding to an associated exhaust valve 204. A spring, or other similar device, biases each of the intake and exhaust valves 158, 204 in a closed position. As the intake and exhaust camshafts 210, 212 rotate, a rise on each cam overcomes the spring bias and opens the valves thereby allowing communication between the intake and exhaust ports 158, 204 with the combustion chamber 142. Thus, air enters the combustion chambers 142 when the intake valves 158 open, and exhaust gasses exit the combustion chamber 142 when the exhaust valves 204 open.

The crankshaft 140 preferably drives the intake and exhaust camshafts 210, 212 through a gearing assembly. A driven gear is affixed to each camshaft 210, 212 which is coupled to a driver gear mounted along the crankshaft 140 by a timing belt or chain. As the crankshaft 140 rotates, the driver gears impart rotational motion to the driven gear via the timing belt or chain, causing the intake and exhaust camshafts 210, 212 to rotate. The rotational speeds of the camshafts 210, 212 may be controlled by varying the diameters of the respective driver and driven gears.

The combustion process drives the pistons 136 downward, thereby imparting a rotational motion to the crankshaft 140, as previously described. The crankshaft 140 is coupled to a jet pump unit which is mounted at least partially in a tunnel 66 formed in the underside of the hull. A jet pump housing 70 is disposed within a portion of the tunnel 66 and communicates with the inlet port 68. An impeller 72 is supported within the housing 70 and is coupled to the crankshaft 140 by an impeller shaft (not shown).

The rear of the housing 70 defines a discharge nozzle 74 which increases the velocity of the discharged water to create thrust to propel the watercraft. Attached to the discharge nozzle is a steering nozzle (not shown) that is pivotable about a generally vertical axis and is couple to pivot concomitant with the turning of the handlebar 48.

When the watercraft 30 is in operation, ambient air enters the engine compartment 196 through air ducts formed in the upper hull section 40. The air then enters the plenum chamber 160 by way of the air inlet ports 176 and passes through the throttle body 180. The throttle valves 54 disposed within the throttle body 180 regulate the amount of air supplied to the combustion chamber 142. The rider controls the opening degree of the throttle valves 54 by varying the throttle lever 52 mounted on the handlebar 48. The air flows into the combustion chamber as the intake valve 158 opens along with a spray of fuel from the fuel injectors under control of the electronic control unit (ECU).

The air/fuel charge in the combustion chamber 142 is compressed by the piston 136, and then ignited by a spark from the spark plug (not shown) under control of the ECU. The exhaust gasses created by the combustion process are discharged to the surrounding body of water through the exhaust system as previously described.

The force generated during the combustion process causes the pistons 136 to reciprocate, thus rotating the crankshaft 140. The rotating crankshaft 140, in turn, drives the impeller shaft, which causes the impeller 72 to rotate in the jet pump unit 70. The rotating impeller 72 draws water into the jet pump unit through the tunnel 66 and discharges it rearward through the discharge nozzle and steering nozzle.

The watercraft 30 is thus under the direction of a rider and is controlled by a throttle lever that controls the speed of the engine and hence the impeller, and a handlebar 48 that controls the direction of travel. In this example, the watercraft 30 is in a planing state when the engine speed is above 4000 rpm.

An engine output control system includes that throttle lever that allows a rider to vary the speed of the engine. The engine output control system can be an electrical or a mechanical system, and thus, movement of the throttle lever can be transmitted as an electrical signal or mechanical movement. The system can also be under the control of the ECU or can be a separate system.

Figure 5:
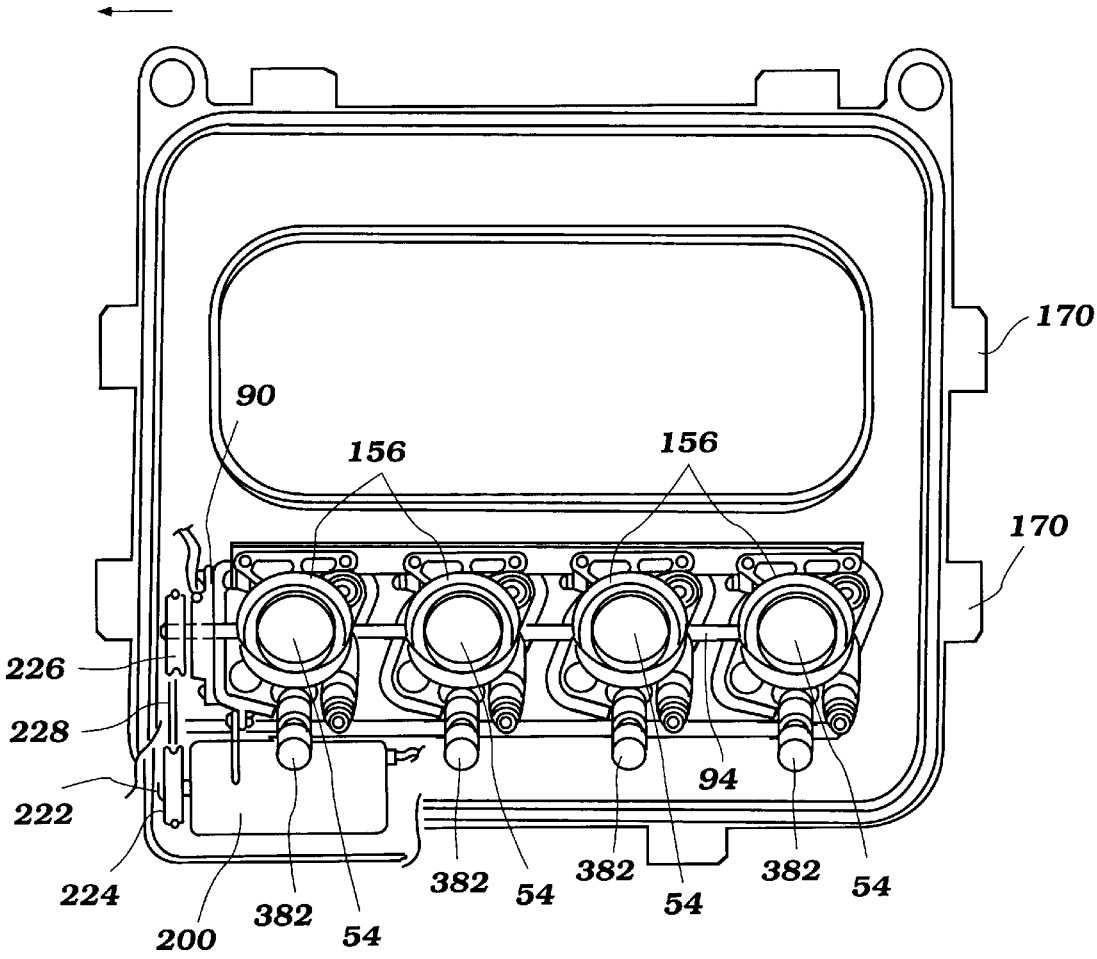
FIG. 5 is a top plan view of the engine of FIG. 4 with a top cover of an induction air box removed and depicts aspects of an engine control mechanism of the engine control system.

One embodiment of an electrical control system is illustrated as in FIGS. 3–5 and best shown schematically in FIGS. 4 and 5 where an electric motor 200 is mounted to the throttle body 180 by a mounting bracket 220 or other similar mounting method. The electric motor 200 has an output shaft 222 that carries a drive gear 224. The drive gear 224 is coupled to a driven gear 226 by a belt or chain 228. Drive and driven pulleys with a corresponding transmitter (e.g., a belt) can alternatively be used. Thus, as the motor 200 drives the drive gear 224, the throttle valve shaft 182 rotates conjointly therewith. Preferably, the electric motor 200 is under the control of the ECU, which ultimate controls the opening or closing of the throttle valves 54. In an embodiment where an electric motor 200 operates the throttle valves 54, the user-actuatable throttle lever 52 inputs a signal to the ECU, which, in turn, includes instructions ultimately delivered to the motor (either in a digital or analog form) for driving the throttle valves 54.

As discussed above, a throttle valve position sensor 90 may be disposed along the throttle valve shaft assembly 182, or may optionally be connected directly to the electric motor 200, and sends a signal to the ECU with information regarding the throttle valve 54 position. In the illustrated embodiment of FIGS. 4 and 5, the sensor 90, and motor 200 are positioned within the plenum chamber 160 defined by the intake box 162, thus isolating and protecting these sensitive components from shock and moisture. For ease of assembly and maintenance, it is preferable that the electric motor output shaft 222 is parallel with the throttle valve shaft 182. However, this need not be the case. Furthermore, the drive gear 224 can be in direct surface contact with the driven gear 226, such as through meshing gear teeth, and the belt 228 may be omitted.

Figure 6A:
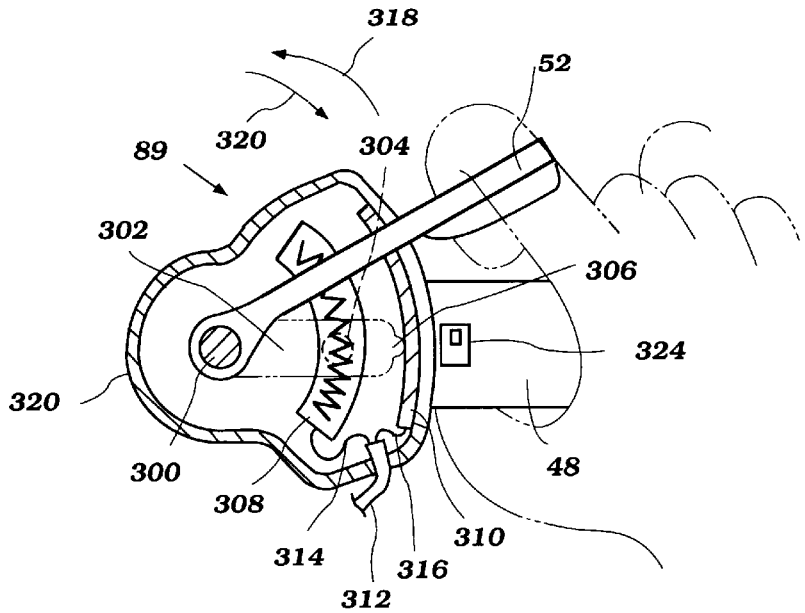
FIG. 6A is a schematic representation of a throttle lever according to one embodiment of the present invention.
Figure 6B:
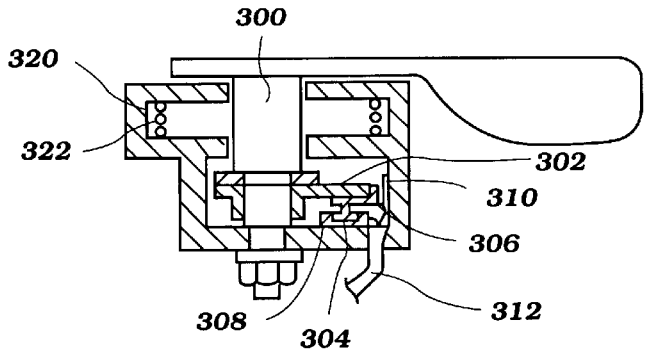
FIG. 6B is a cross-sectional view of the throttle lever of FIG. 6A.

One embodiment of the throttle lever position sensor 89 is illustrated in FIGS. 6A and 6B. In the illustrated embodiment, the throttle lever position sensor 89 is integrated into the throttle lever 52 mechanism in the form of a rheostat or potentiometer and is mounted to a handlebar 48 of a watercraft. The throttle lever 52 is attached by, and pivotable about, a mounting pin 300, such as a bolt. A wiper arm 302 is also pivotable about the mounting pin 300 and is constrained to move with the throttle lever 52. The wiper arm 302 has a first electrical contact 304 that is in electrical communication with a resistor element 308 and a second electrical contact 306 that is in an conductive relationship with a conductor plate 310.

A wire 312 carries an electrical current through a series circuit defined by a first wire lead 314 connected to the resistor element 308 and wherein the wiper arm 302 creates a bridge from the resistor element 308 to the conductor plate 306 where the current is returned through a second wire lead connected to the conductor plate. The resistor element 308 is variable in length as the wiper arm 302 is able to move axially thereon. As the wiper arm moves in a counter-clockwise direction 318, the effective length of the resistor element 308 increases, thereby increasing the resistance in the circuit. Conversely, as the wiper arm 308 moves in a counter-clockwise direction 320, the effective length, and thus the circuit resistance, decreases. This variable causes a change to the voltage across the circuit, which is detectable by the ECU.

The ECU can then interpret this voltage into a corresponding signal that controls the electric motor 200 and hence controls the throttle valves 54. The electrical components described are preferably housed in a watertight throttle lever case 320 to protect the components from exposure to moisture.

FIG. 6B illustrates that the throttle lever 52 is biased by a return spring 322 that biases the throttle lever 52 to move to a position that corresponds with a closed throttle position. Thus, when a rider releases the throttle lever, the engine returns to an idle operating condition.

In the illustrated embodiment of FIG. 6B, the wiper arm 302 is constrained to rotate with the throttle lever 52. A first contact 304 tracks within a groove formed in the resistor element 308, and has a second contact portion 306 that is in electrical contact with the conductor plate 310. Because the wiper arm 302 pivots about a pin 300, its is preferable that the resistor element 308 and the conductor plate 310 are configured with a similar curvature to enable the wiper arm 302 to maintain electrical contact throughout its range of motion.

An engine modality switch 324 is provided to allow an operator to adjust the operating capabilities of the engine. The switch 324 is illustrated as being mounted directly to the handlebar; however, this mounting location is exemplary only as the engine modality switch may be mounted in any of a number of places, such as, for example, on the cover member 56, on a display panel, on the upper hull 40, or even under the seat 60. In the illustrated embodiment, the switch is preferably a 2-way toggle switch that allows the rider to select between two preset engine operating modes. For example, the switch may allow a rider to select between a normal operating mode and an economy operating mode in which the engine rpm is limited at its top end. The switch also can be an electrical switch rather than a mechanical switch and can receive instructions from an external source (either by hardwire or by a transmitter/receiver communication).

Figure 6C:
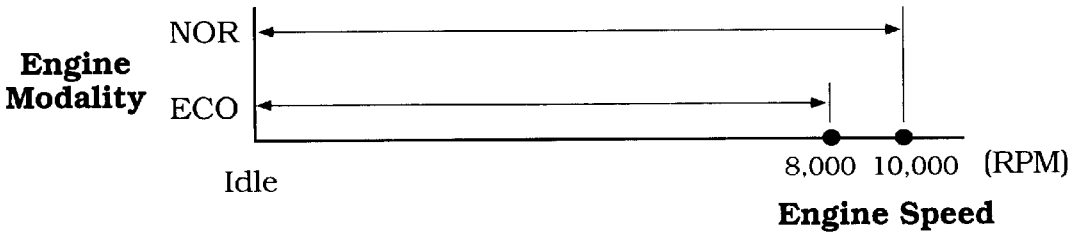
FIG. 6C is a graph showing the operating range of the engine depending on the state of selection of an engine operating mode selector.

FIG. 6C illustrates the engine rpm range based on the setting of the engine modality switch 324. When the engine is set to the normal mode, the engine is fully operational throughout its designed rpm range, which in this example is from idle to about 10,000 rpm at top speed. In an economy mode, for example, the engine is limited to be operational between idle and about 8,000 rpm. These figures are used for illustration only; the present engine control system can be designed to operate the engine over other ranges of speeds. It should also be apparent to those skilled in the art that the engine modality switch need not be limited to a 2-way toggle switch. The modality switch 324 can allow a greater number of discrete engine operating modes, such as, for example, but without limitation, 3 or 4, or can take the form of an adjustable potentiometer or rheostat thus allowing a variable engine operating range.

Thus, the illustrated embodiment provides an engine control system in which an engine modality switch 324 allows a rider to select the operating range of the engine. This may be useful for many reasons, such as, for example, to maximize the fuel economy of the engine or to make the watercraft more docile for novice users, among others. Thus, the modality switch can be located at less accessible areas on the watercraft in order to allow an owner of the watercraft (e.g., a rental company) to restrict the speed of the watercraft if desired.

Figure 7A:
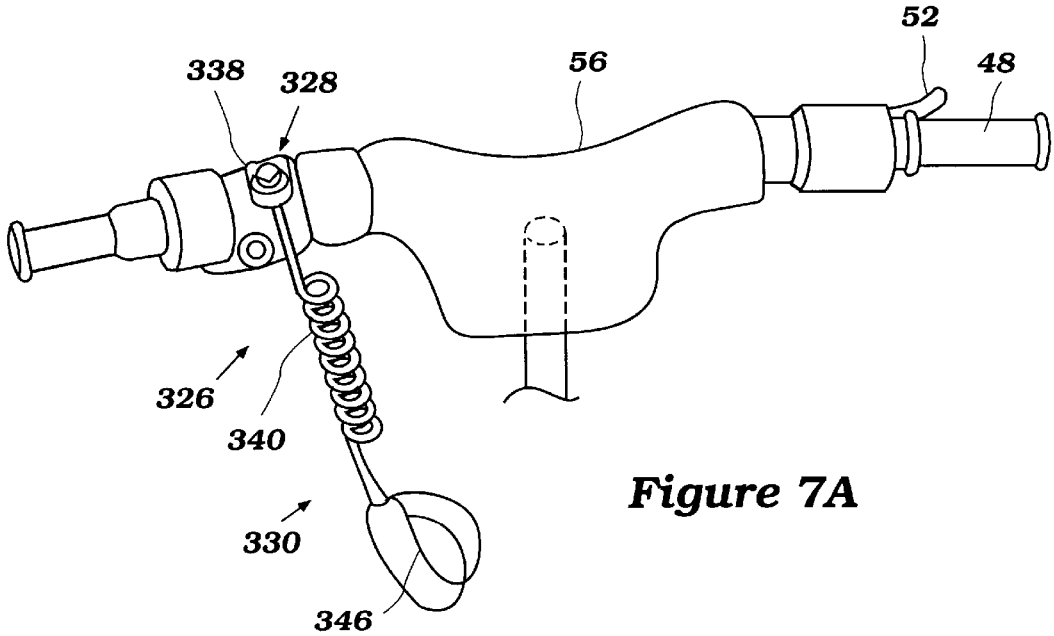
FIG. 7A is an illustration of a watercraft handlebar showing a lanyard.
Figure 7B:
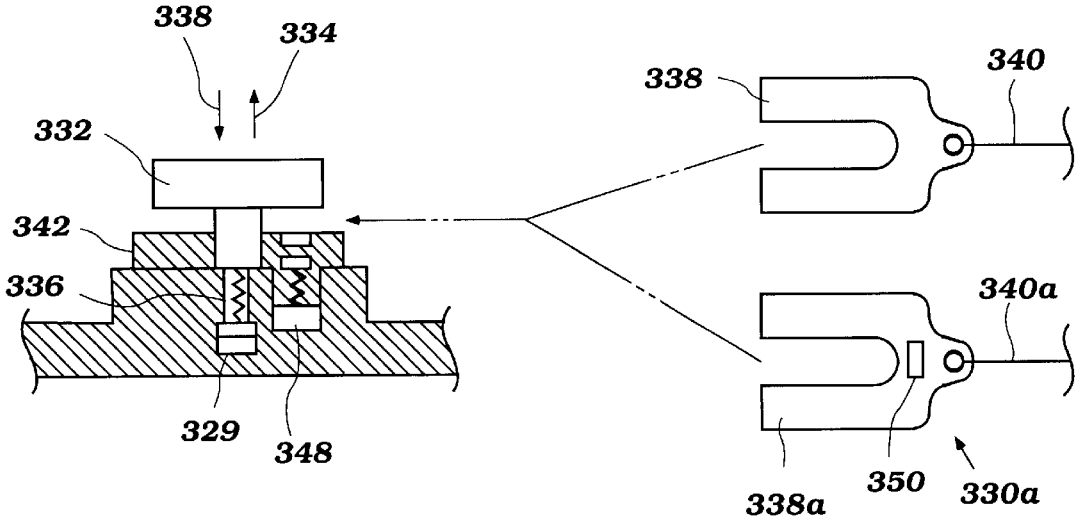
FIG. 7B illustrates an embodiment of an automatic engine operating mode selector.

The modality switch may also be a manually actuatable switch, as illustrated in FIG. 6, or may be in the form of an automatic switch as is illustrated in FIGS. 7A and 7B.

If desired, the watercraft can include a switchover mechanism to selectively activate or disable the ECU's engine output control mode. An exemplary switchover mechanism will be described below.

Personal watercraft typically are provided with a lanyard switch unit 326 that permits the engine to be started when inserted and disables the engine when it is removed. The lanyard switch unit 326 includes a switch section 328 and a lanyard or tether section 330. The switchover mechanism along with the engine modality switch 324 can be incorporated into the lanyard switch unit 326.

In the illustrated embodiment, the switch section 328 is formed on the handlebar 48 and defines a main power switch of the watercraft 30. The switch section 328, however, can be disposed at other locations on the watercraft, such as, for example, on the deck just forward of the seat and beneath the handlebar 48, and can function simply as a switch in the start and kill circuits of the watercraft rather than as the main power switch of the watercraft 30. The switch section 328 has a combination 329 of a fixed contact and a moveable contact, which is schematically illustrated in FIG. 7B. When the moveable contact is connected to the fixed contact, a battery is connected to the electrical equipment of the engine and the engine can be started. When the moveable contact is disconnected from the fixed contact, however, the battery is disconnected from at least some of the electrical equipment and a kill circuit is activated. The switch section 328 also has a knob 332 that is moveable along an extending axis thereof. The knob 332 moves in a direction indicated by the arrow 334 and is biased in the opposite direction, such as by a spring 336. When the knob 332 is moved in the direction of arrow 334 and held in a connected position, the movable contact mates with the fixed contact. But when the knob 332 is biased in the direction of arrow 338 back to a disconnected position, the moveable and fixed contacts no longer mate.

The lanyard section 330 has a forked member 338 and a lanyard 340. The forked member 338 is connected with one end of the lanyard 340 and acts as a spacer that is disposed in a space defined between a switch body 342, which contains the contact combination, and the knob 332 so as to hold the contact combination in the connected position. The other end of the lanyard 340 defines a closed circular portion 346 so that a rider can put it around his or her wrist or attach it to a belt loop or the like. In the event the rider falls off the watercraft 30 while the lanyard is inserted, the forked member 338 is pulled from the space and the knob 332 returns back to the disconnected position. Engine operation accordingly stops.

The switch body 342 in the illustrated embodiment has another switch mechanism 348, next to the contact combination 329, that can selectively activate and disable the ECU. This switch mechanism 348 defines a proximity switch that senses magnetism. The switch mechanism 348 can of course use other switch constructions, such as, for example, but without limitation, a contact switch construction including a fixed contact and a moveable contact.

In conjunction with this switch mechanism 348, the forked member 338*a* includes a magnet piece 350. The forked member 338*a* is connected to a lanyard 340*a* as previously described in conjunction with the first lanyard section 330. If the second lanyard section 330*a* replaces the first lanyard section 330, the magnetic piece 350 of forked member 338*a* exists adjacent to the proximity switch mechanism 348 so that the ECU is activated and the main switch is turned on.

Another control strategy is practicable with the interchangeable switch mechanism. For instance, when the second lanyard section 330*a* is selected, the ECU can cap engine output. If the maximum output of the engine is 100 h.p. (engine speed of about 7,000 rpm), the ECU can restrict the engine's output to 80 h.p. (engine speed of about 6,000 rpm). This control strategy may be an alternative to the manual engine modality switch 324 discussed in relation to FIGS. 6A and 6B. Furthermore, additional lanyard sections may be insertable having differing magnetic characteristics such that the ECU receives a signal corresponding with each individual lanyard section and can vary the maximum engine output accordingly. Therefore, it is conceivable that individual lanyard sections may be available for novice, intermediate, and expert riders and can vary the maximum engine output accordingly.

Figures 8A, 8B, 8C:
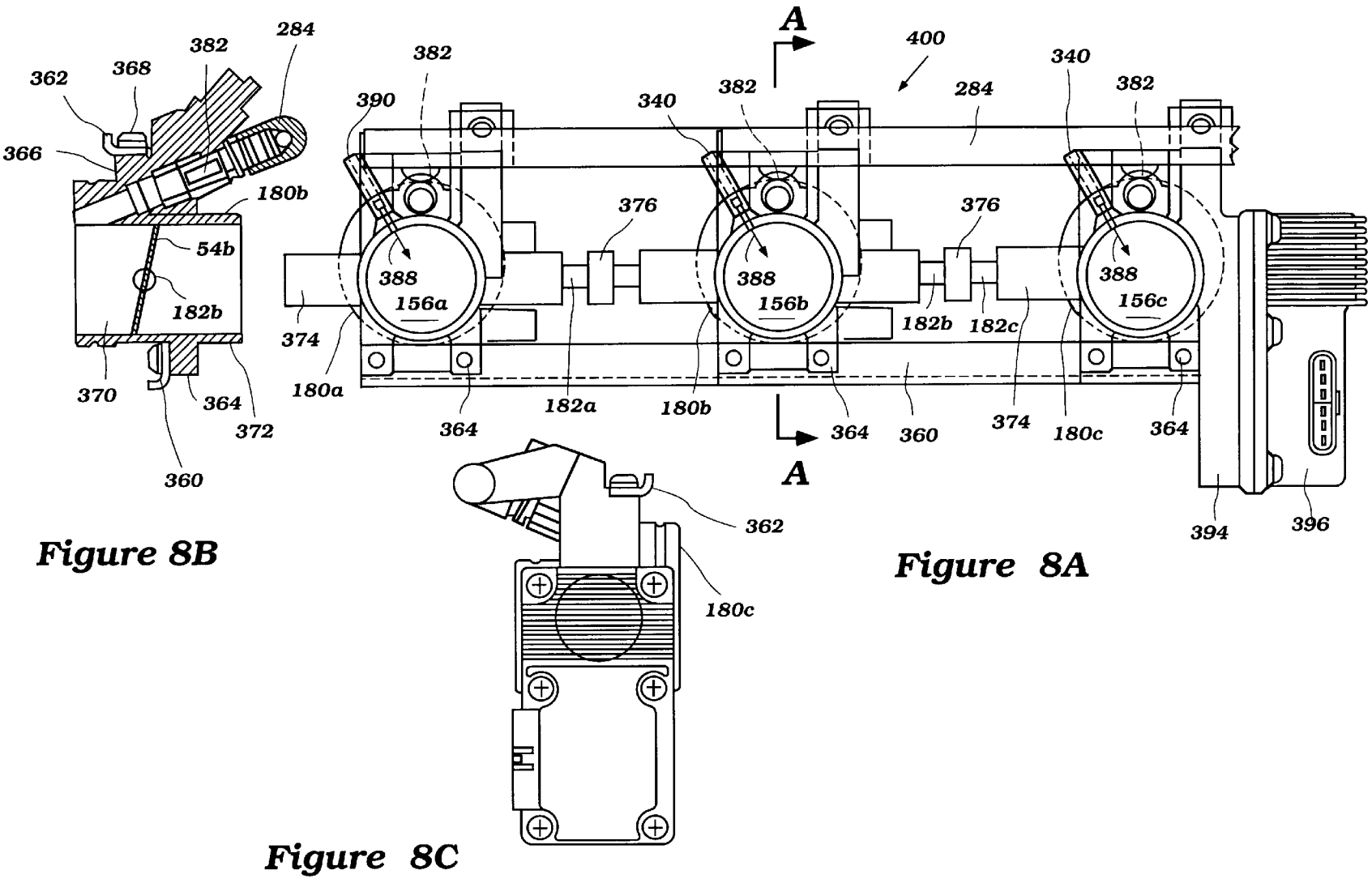
FIG. 8A is a side view of an engine control mechanism configured in accordance with another embodiment of the present invention that can be used in the engine control system.
FIG. 8B is a section view of the engine control mechanism taken along the line A—A of FIG. 8A.
FIG. 8C is a front view of the engine control mechanism.

With reference to FIGS. 8(A)–(C), another embodiment of an electronic engine output control system will be described. The same reference numerals will be assigned to the same components and members that have already been described and further detailed description of such components and members will be omitted.

The engine in this embodiment also operates on a two-cycle crankcase compression principle and has three cylinders. Three throttle bodies 180*a*, 180*b*, 180*c* are separately formed and coupled together by a lower linkage rail 360 and an upper linkage rail 362. That is, each throttle body 180*a*, 180*b*, 180*c* has a lower flange 364 that extends downward from the bottom thereof and defines a vertical face. Each throttle body 180*a*, 180*b*, 180*c* also includes an upper flange 366 that extends upward and defines a horizontal face. The respective lower flanges 364 are affixed to the vertical faces of the lower linkage rail 360 by screws 218, while the respective upper flanges 366 are affixed to the respective horizontal faces of the upper linkage rail 362 by screws 368. The linked throttle bodies 180*a*, 180*b*, 180*c* are affixed to the crankcase member of the engine body one side of the engine (e.g., the starboard side). One end 370 of each throttle body 180*a*, 180*b*, 180*c* communicates with the crankcase chamber through an appropriate intake manifold and the other end 372 communicates with the plenum chamber via an appropriate sleeve. The throttle valve shafts 182*a*, 182*b*, 182*c*, which support the throttle valves 54*a*, 54*b*, 54*c*, are journaled by bearing portions 374 of the throttle bodies 180*a*, 180*b*, 180*c* for pivotal movement. Coupling members 376 couple the throttle valve shafts 182*a*, 182*b*, 182*c* with one another so that all of the valve shafts 182*a*, 182*b*, 182*c* rotate together. Return springs are provided around the respective throttle valve shafts 182*a*, 182*b*, 182*c* in the bearing portions 374 to bias the shafts 182*a*, 182*b*, 182*c* toward a position in which the throttle valves 54*a*, 54*b*, 54*c* are closed. In other words, the throttle valves 54*a*, 54*b*, 54*c* are urged toward the closed position unless an actuation force acts on the valve shafts 182*a*, 182*b*, 182*c*.

The fuel injectors 382 are affixed to the throttle bodies 182*a*, 182*b*, 182*c* so that each nozzle portion of the injector 382 is directed to the intake passage 156*a*, 156*b*, 156*c* downstream of the throttle valve 54*b*. A fuel rail 384 is affixed to the throttle bodies 182*a*, 182*b*, 182*c* so as to support the fuel injectors 382 and also to form a fuel passage 236 therein through which the fuel sprayed by the injectors 382 is delivered.

In the illustrated embodiment, lubricant oil 388 is also injected toward the journaled portions of the valve shafts 182*a*, 182*b*, 182*c* in the intake passages 156*a*, 156*b*, 156*c* through oil injection nozzles 390. Lubricant injection at this point tends to inhibit salt water from depositing on the valve shafts and at the journaled portions of the valve shaft.

A motor flange 394 is unitarily formed with the most forward portion of the throttle body 180*c* and a valve control motor 396 is affixed thereto. The throttle valve shafts 182*a*, 182*b*, 182*c* in this arrangement are actuated only by this motor 396 in either a manual control mode by the rider or the engine output control mode by the ECU 86. No mechanical control wire or cable connects the throttle lever 52 and the valve shafts 182*a*, 182*b*, 182*c*. Instead, the throttle lever 52 is connected to a throttle lever position sensor that sends a signal to the ECU 86 through a signal line.

The engine output control mechanism 400 needs no throttle position sensor because the motor 396 has a built-in position sensor by which a signal indicating a position of the throttle shafts 182*a*, 9*b*, 182*c* is sent to the ECU 86. A watertight cover protects the motor 396. Because of the arrangements and constructions of the throttle bodies and valve control motor, the engine output control mechanism 400 is simple, accurate and durable.

Figure 9:
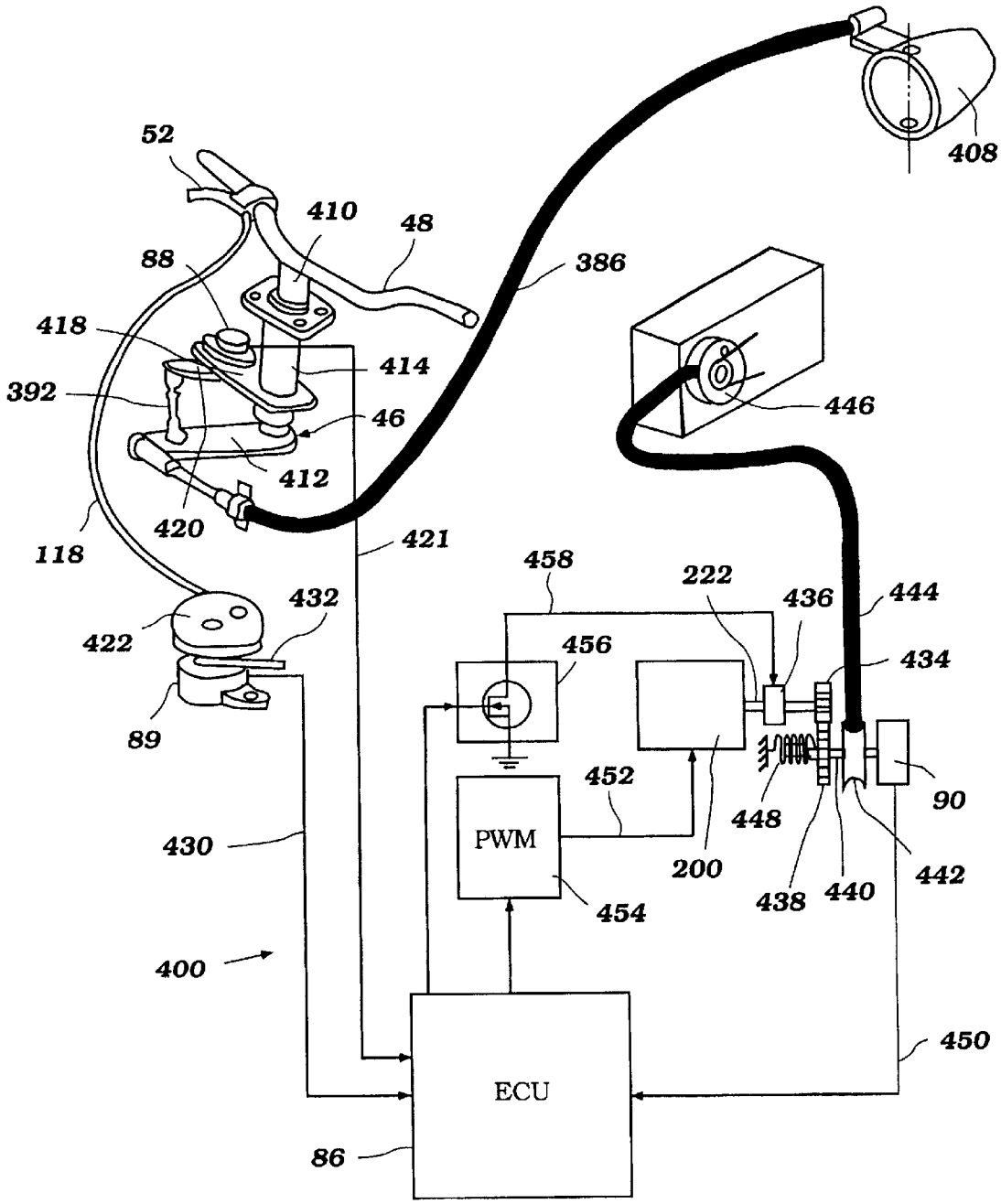
FIG. 9 is a schematic view showing an engine control system configured in accordance with another preferred embodiment.

FIG. 9 illustrates another embodiment of an electronic engine output control system 400. The steering mast 46 includes a steering shaft 410, the handlebar 48, a steering arm 412 and a tubular steering column 414. While the handlebar 48 is formed atop the steering shaft 410, the steering arm 412 is rigidly affixed to the bottom portion of the steering shaft 410. The steering column 414 is affixed to the upper hull section 40. The steering column 414 supports the steering shaft 410 for steering movement. With the rider steering with the handlebar 48, the steering arm 412 moves generally in a plane normal to the steering shaft 410. The steering arm 412 is connected to the deflector 408 through a deflector cable 386, and the deflector 408 pivots about a vertical axis with the movement of the steering arm 412 in a known manner. A sensor arm 418 on which the steering position sensor 88 is disposed is rigidly affixed to the steering column 414. A lever 420 extends from the sensor 88 and a linkage member 392 couples the lever 420 with the steering arm 412. Because the lever 420 pivots with the movement of the steering arm 412, the steering position sensor 88 senses an angular position of the steering shaft 410. The sensed signal is set to the ECU 86 through a signal line 421.

The throttle lever 52 on the handlebar 48 is connected to a pulley 422 affixed to a shaft of a throttle lever position sensor 89 through a throttle wire 118. This throttle position sensor 89 is not affixed to the throttle valve shafts 182 but rather is separately provided for remotely sensing a position of the throttle lever 52. The sensed signal is sent to the ECU 86 through a signal line 430. Because the throttle valves 54 desirably are controlled by the throttle lever 52, the position of the throttle valves 54 should generally correspond to the position of this lever 52. A return spring 432 is provided at the throttle position sensor 89 so as to return the shaft of the position sensor 89 to an initial position unless the rider operates the throttle lever 52.

The control system 400 employs another engine output control mechanism. This control mechanism includes an electric motor 200 having a motor shaft 222. A first gear 434 is coupled with the motor shaft 222 via a clutch 436. Unless the clutch 436 is activated, the motor 200 does not rotate the first gear 434 and the first gear 434 merely idles. The first gear 434 meshes with a second gear 438 that in turn is coupled to a second shaft 440. Because a diameter of the second gear 438 is larger than a diameter of the first gear 434, a rotational speed of the second shaft 440 will be reduced relative to the rotational speed of the motor shaft 222.

A pulley 442 is affixed to the second shaft 440. The throttle bodies 180 also have a pulley 446 that actuates the throttle shafts 182. An actuator cable 444 connects together the pulleys 442, 446. A return spring 448 is affixed to one end of the second shaft 440 so as to return the first and second gears 434, 438 to their initial positions unless the clutch 436 is connected. A position sensor 90 is affixed to the other end of the reduction shaft 440 to sense an angular position of the shaft 440. The position sensor 90 sends a signal, which is indicative of the angular position of the shaft 440, to the ECU 86 through a signal line 450 for feedback control of the clutch 436 and/or the motor 200. The signal sensed by the position sensor 90 corresponds to the position of the throttle valves 54.

The position sensor 90 as well as the throttle lever position sensor 89 can be any type of angular position sensors such as a potentiometer type like the sensor 90 used in the preceding embodiments or a Hall IC type sensor.

The ECU 86 controls the motor 200 through a control line 452. A pulse width modulator or power amplifier 454 preferably is provided between the ECU 86 and the motor 200 to directly control the motor 200.

The ECU 86 also controls the clutch 436 through a control line 458. A switch 456, e.g., FET switch, preferably is provided between the ECU 86 and the clutch 436 to actuate the clutch 436. When a power switch, i.e., main switch, of the watercraft 30 is off, the ECU 86 is off and the switch 440 is disconnected. In the event of malfunction of the motor 200, the switch 456 is biased off and accordingly the clutch 436 is disconnected so that the throttle valves 54 can be manually operated.

The ECU 86 has a ROM to store at least a reference position of the steering shaft 410 and also has a RAM to store at least a current position signal of the throttle lever 52 and a change rate of the position signal. The ECU 86 also has a timer.

In this disclosed embodiment, the ECU is responsible for coordinating the movement of the throttle lever 52 with the corresponding rotation of the throttle valves 54. Generally, the resulting rotation of the throttle valves 54 will be proportional to the movement of the throttle lever 52. However, when the ECU 86 senses a change in the engine modality switch 324, the ratio of the throttle valve 54 rotation relative to the pivoting of the throttle lever 52 can be altered such that full range of motion of the throttle lever 52 doesn't necessarily correspond with the full range of motion of the throttle valve 52. For example, as discussed in conjunction with FIGS. 6(A)–(C), the maximum engine output may be limited to a speed lower than its design limits. In this way, the ECU 86 is responsible for governing the maximum output of the engine based upon an engine modality selector input. The illustrated embodiment may also have other uses, as described by the control routine of FIG. 10.

FIG. 10 illustrates a control routine of the control system 400. The control routine starts at Step S21 when the rider turns on the main power switch. At Step S22, the ECU initializes stored data of the RAM and proceeds to Step S23. The timer starts to count time ($T_0$) at Step S23. At Step S24, the ECU 86 determines a closed position of the throttle valves 54 from the signal of the throttle valve position sensor 90. The ECU then determines whether the time ($T_0$) counted by the timer exceeds 0.25 seconds (Step S25). If 0.25 seconds has not elapsed, the ECU returns to Step S24 to repeat this step. If the time has elapsed, the ECU instructs the switch 440 to connect the clutch 436 (Step S26). Steps S21 through S26 comprise an initializing phase of the routine and are not repeated until engine is stopped and restarted.

At Step S27, the ECU 86 reads a current throttle lever position from the signal sensed by the throttle lever position sensor 89. The ECU then calculates the rate of change of the throttle lever position (Step S28). If the rate of change is zero, the rider wants to maintain the current throttle position. A large rate of change indicates quick movement of the throttle lever (e.g., when accelerating from rest) and a small rate of change indicates slow movement of the throttle lever (e.g., when docking the watercraft at which time the rider may more precisely control the throttle lever for slow speed maneuvering).

The ECU 86 then determines (at Step S29) whether the closed position of the throttle valves, which was read and stored into memory at Step S24, falls within a range defined between a reference upper limit (RUL) and a reference lower limit (RLL). If it does, the ECU proceeds to Step S31. If not, the ECU performs Step S30.

At the step S30, the ECU 86 selects either the reference upper limit (RUL) or the reference lower limit (RLL) as a hypothetical closed position. For example, the ECU may be programmed to determine which one of the RUL or RLL is closer to measured value, and then use the closest one as the hypothetical closed position. The ECU then proceeds to the Step 31.

At Step S31, the ECU 86 determines whether the engine 32 is in an idle state, i.e., whether the throttle valves 54 are closed. This determination uses either the actual closed position sensed by the throttle valve position sensor 90 or the hypothetical closed position replaced at the step S30, depending upon the conclusion reached at Step S29. The idle engine speed of the engine 32 is, for example, 1,200 rpm. If the engine is operating above idle, the ECU proceeds to Step S39 to instruct the pulse width modulator 454 to practice a normal control mode for controlling the throttle drive motor 200. If, however, the engine is at idle, the ECU proceeds to Step S32.

The pulse width modulator 454 practices the following two controls at the step S39. The first control (i.e., Control (1)) involves bringing the actual throttle opening degree sensed by the throttle valve position sensor 90 close to the desired throttle opening sensed by the throttle lever position sensor 89. For this purpose, any deviation between these two sensed values preferably is minimized to the extent possible by actuating the motor 200 to move the throttle valves 54.

The second control (i.e., Control (2)) involves controlling the motor 200 through the pulse width modulator 454 in response to the change rate calculated at Step S28. If the rate of change is large, the modulator 454 supplies the motor 200 with a relatively high power level so that the motor 200 rotates at a relatively high speed. If the rate of change is small, then the modulator 454 supplies the motor 200 with a relatively low power level so that the motor 200 rotates at a relatively low speed. After performing Step S39, the program returns to Step S27.

If the ECU determines that the throttle valves are closed (Step S31), the ECU 86 then determines at Step S32 whether the steering position sensed by the steering position sensor 88 is greater than a reference steering position (RS). If no, the ECU does not begin its engine output control mode and proceeds to control the modulator 454 in its normal manner (Step S39). If, however, the sensed steering position is greater than the reference steering position (RS), i.e., the rider has turned the steering bar 48 by more than a predetermined degree, the ECU proceeds to Step S33 for a further calculation before deciding whether to begin its engine output control mode.

The ECU 86 at Step S33 determines whether the throttle valve opening, and consequently the engine output, is increasing. The assessment of this situation can be determined from whether the actual throttle opening degree is increasing from the closed position under the rider's own control. If yes, the program proceeds to Step S39. If not, the ECU begins its engine output control mode (Step S34). This step S33 is advantageous if a manual control or an independent control of the throttle valves is employed. This step S33, however, can be omitted in the illustrated control system 400.

At Step S34, the ECU 86 instructs the pulse width modulator 454 to drive the motor 200 in a direction that increases the throttle valve opening degree. Under this control, the throttle valves are opened to a predetermined throttle opening that corresponds with a desired engine speed. In one embodiment, the engine speed preferably is increased to within the range of about 1,500 to about 4,000 rpm, and more preferably to within the range of about 2,500 to 3,500 rpm, and in one embodiment, to 3,000 rpm. The desired engine speed preferably is sufficient to effect sharp turning of the watercraft. The ECU 86 then starts the timer (Step S35) to count off a predetermined amount of time (i.e., starts a count down).

At Step S36, the ECU 86 determines whether the throttle lever position is greater than the idle position. If yes, the rider is operating the throttle lever 52 to increase the engine output and the program proceeds to Step S38 to stop the engine output control mode. If no, the ECU proceeds to Step S37.

At Step S37, the ECU determines whether the timer has finished the count down. The time period of this count down is preferably within the range of from about 1 second to 5 seconds, and in one embodiment, is about 3 seconds. If this time has not elapsed, the ECU repeats Step S36. If the time has expired, the ECU ceases the engine output control mode (Step S38), and returns to the main control routine at Step S27.

Although this engine control system has been described in terms of certain preferred embodiments, other embodiments and variations of the foregoing examples will be readily apparent to those of ordinary skill in the art. For example, the output of the throttle valve position sensor in the described embodiments can be directly or indirectly used as a control parameter of the ECU. That is, for example, a sensed throttle opening degree, an absolute value of the sensed opening degree, an increase or decrease amount of the opening degree and a rate of change of the opening degree can all be used as the control parameter(s).

Additionally, the output of the steering position sensor can be directly or indirectly used as another control parameter of the ECU 86. That is, for example, a sensed angular position, an absolute value of the sensed angular position, an increase or decrease amount of the angular position and a rate of change of the angular position are all applicable as the control parameter(s).

The output of the velocity sensor can be directly or indirectly used as a further control parameter of the ECU. That is, for example, a sensed velocity, an absolute value of the velocity, an increase or decrease amount of the velocity and a change rate of the velocity are all applicable as the control parameter.

The sensors can be positioned not only in close proximity to thing that they are measuring but also at a remote place. If the sensors are remotely disposed, an appropriate mechanical, electrical or optical linkage mechanism can be applied.

Conventional sensors are all applicable as the sensor described above whether they are given as examples or not. Additionally, conventional actuators using, for example, electrical power or fluid power (e.g., air pressure, water pressure or hydraulic oil pressure) are all applicable as the actuator for the engine output control whether they are exemplified or not.

Figure 11:
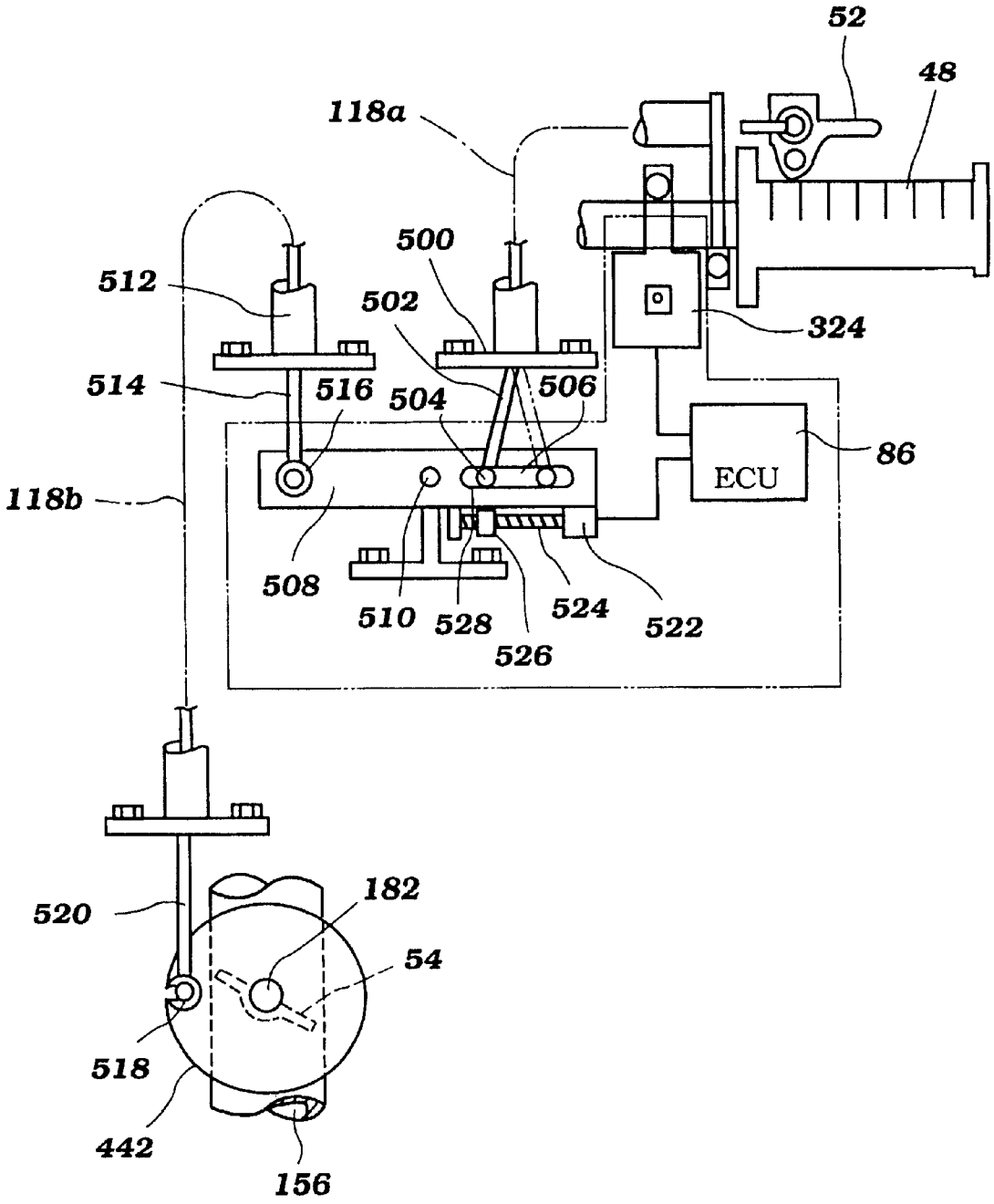
FIG. 11 is another engine control system configured in accordance with an additional preferred embodiment of the present invention.

FIG. 11 illustrates a mechanical embodiment of an engine output control system. As illustrated, a throttle lever 52 is pivotally mounted on a handlebar 48. A throttle cable 118*a* is secured to the throttle lever 52 such that a tensioning force is translated through the throttle cable 118 when the throttle is pivoted. The throttle cable 118*a* passes through a first mounting bracket 500 that is fixedly attached to the engine 32, and connects to a connecting rod 502. The connecting rod has a protruding portion 504 that tracks within a slot 506 formed in a moment lever 508 toward one end thereof. The moment lever 508 is pivotally secured at 510 by any suitable mechanism that provides a fulcrum. The opposing end of the moment lever 508 is pivotally secured to a throttle cable 118*b* which passes through a second mounting bracket 512. The throttle cable 118*b* may be secured directly to the moment lever 508 or may optionally be secured by a connecting rod 514 or similar device. If a connecting rod is utilized, it preferably is configured with a hole 516 to pivotally attach to the moment lever 508, which may be accomplished by securing the hole 516 to a protruding boss on the moment lever 508, or by a fastener, or similar pivotal connection.

The throttle cable 118*b* is further connected to a throttle pulley 442 connected to the throttle valve shaft 182 as described herein. The throttle cable may be connected to the throttle pulley 442 directly or by any suitable pivotal connection, such as a C-clamp 518 fixed to a connecting rod 520.

In this manner, as the throttle lever 52 is actuated, the throttle cable 118*a* translates a linear displacement to the moment lever 508, which pivots on its fulcrum 510 thereby translating a tension force through the throttle cable 118*b* and actuating the throttle shaft 182 and accompanying throttle valve 54. The described embodiment thus provides a simple mechanical interface for translating a throttle lever 52 displacement directly into a corresponding throttle valve opening angle.

There may be provided an engine modality switch 324 as previously described herein. A modality switch 324 sends a signal to the ECU 86 corresponding with a selected engine modality. The ECU 86 then actuates an electric motor 522 whose output is coupled to a power screw 524. A threaded follower 526 is disposed on the power screw 524 and is in threaded engagement therewith. The follower 526 is additionally coupled to the protruding portion 504 of the connecting rod 502 such that a linear displacement of the threaded follower 526 causes a corresponding linear displacement of the protruding portion 504 of the connecting rod 502. The protruding portion 504 is in sliding contact with a slot surface 528, and thus the friction therebetween must be overcome. This may be accomplished by providing materials that have a relatively low coefficient of friction, such as plastic or some metals. Alternatively, the protruding portion 504 may be a roller configured to roll within the slot 506.

In operation, when the modality switch 324 sends a signal to the ECU denoting a change of state, the ECU control the electric motor 522 to drive the screw 524 a predetermined amount and thus linearly translate the threaded follower 526 and attached connecting rod 502 between a first and second position. By varying the distance the connecting rod 502 interfaces with the moment lever 508 from the fulcrum 510, the output range of motion may be varied. For example, if the connecting rod 502 interfaces with the moment lever 508 in a first position that is close to the fulcrum 510, then a small vertical displacement by the throttle cable 118*a* results in a substantially larger displacement of the opposing end of the moment lever 508 and attached connecting rod 514. Conversely, if the connecting rod 502 interfaces with the moment lever 508 at a second position farther away from the fulcrum 510, a larger vertical displacement by the throttle cable 118*a* is required to result in the same amount of displacement on the output end of the moment lever 508. The result is a variable displacement mechanism that varies the ratio of the displacement of the connecting rod 502 to the displacement of the opposing end of the moment lever 508 and attached connecting rod 514. As used herein the term "variable displacement mechanism" is generally used to refer to a mechanism that varies the displacement of the throttle valve relative to the throttle lever.

Accordingly, the ratio of the travel distances of the throttle lever 52 and throttle valves 54 may be varied. Preferably, when the throttle lever 52 is released, the first and second positions result in the same orientation of the moment lever 508, and consequently, the same idle position of the throttles. This may be accomplished by ensuring that the first and second positions of the connecting rod 502, relative to the moment lever 508 resemble an equilateral triangle, where the moment lever 508 is the triangle base.

As described above in relation to the electronic engine output control embodiments, the engine modality switch may be configured to toggle between two or more engine modalities. And although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising:

a hull defining an operator's area;

an engine having at least one air intake regulator being movable through a first range of opening positions from an idle position to a fully open position;

an engine speed control operator remotely positioned relative to the engine and coupled to the air intake regulator, the engine speed control operator being movable between a first position and a second position; and an engine control system comprising a controller coupled to the air intake regulator to at least selectively control the air intake regulator, the controller configured to provide a first mode of engine operation, in which movement of the engine speed control operator between the first and second positions causes the air intake regulator to move through the first range of opening positions from the idle position to the fully open position, respectively, and at least a second mode of engine operation, in which movement of the engine speed control operator between the first and second positions caused the air intake regulator to move through a second range of opening positions, the second range of opening positions being less than the first range of opening positions and including an opening amount sufficient to propel the watercraft at a planing speed, and an engine modality selector in communication with a controller, the modality selector being selectable between at least two states corresponding to the at least two modes of engine operation provided by the controller, the modality selector configured to output a modality signal to the controller that is indicative of a desired mode of engine operation and the controller configured to control the engine in response to the modality signal, the modality selector being positioned in the operator's area such that the modality selector can be switched without removing a lanyard.

2. The watercraft of claim 1, wherein the second range of opening positions includes the idle position.

3. The watercraft of claim 1, wherein the air intake regulator is a throttle valve.

4. The watercraft of claim 1, wherein the controller is configured to control the maximum opening position of the air intake regulator.

5. The watercraft of claim 1, wherein the engine speed control operator is a lever mounted on a handlebar of the watercraft.

6. The watercraft of claim 1, wherein the engine speed control operator is coupled to the air intake regulator by a cable.

7. A watercraft comprising:

an engine having at least one air intake regulator being movable through a first range of opening positions from an idle position to a fully open position;

an engine speed control operator remotely positioned relative to the engine and coupled to the air intake regulator, the engine speed control operator being movable between a first position and a second position; and an engine control system comprising a controller coupled to the air intake regulator to at least selectively control the air intake regulator, the controller configured to provide a first mode of engine operation, in which movement of the engine speed control operator between the first and second positions causes the air intake regulator to move through the first range of opening positions from the idle position to the fully open position, respectively, and at least a second mode of engine operation, in which movement of the engine speed control operator between the first and second positions caused the air intake regulator to move through a second range of opening positions, the second range of opening positions being less than the first range of opening positions, and an engine modality selector in communication with a controller, the modality selector being selectable between at least two states corresponding to the at least two modes of engine operation provided by the controller, the modality selector configured to output a modality signal to the controller that is indicative of a desired mode of engine operation and the controller configured to control the engine in response to the modality signal, wherein the engine control system additionally comprises a variable displacement mechanism to vary the ratio of displacement of the engine speed control operator to the engine speed control displacement depending upon the state of the modality selector.

8. The watercraft of claim 1, wherein the controller is coupled to the air intake regulator through an actuator to control the air intake regulator under at least the first and second modes of engine operation.

9. The watercraft of claim 1, wherein the modality selector is mounted to a handlebar of the watercraft.

10. A watercraft comprising:

a hull defining an operator's area;

an internal combustion engine;

a jet propulsion unit driven by the internal combustion engine;

an engine output control system to restrict the quantity of air that is taken in by the engine; and a switching means for switching the engine output control between an air-restricting state, and an unrestricting state, the switching means being disposed in the operator's area such that an operator can switch the switching means between the air-restricting and an unrestricting states without removing a lanyard;

whereby the maximum output of the engine is limited when the engine output control is in the air-restricting state, the maximum output in the air-restricting state being sufficient to propel the watercraft at a planing speed.

11. The watercraft of claim 10, wherein said switching means is mounted to a handlebar of the watercraft.

12. The watercraft of claim 10, further comprising a throttle valve disposed within the internal combustion engine that has an opening degree movable through an idle position and a fully open position, and wherein the engine control system closes the throttle valve to restrict the amount of air taken in by the engine.

13. The watercraft of claim 12, further comprising an electronically driven actuator coupled to the engine control system to control the throttle valve opening degree.

14. A watercraft comprising:

an internal combustion engine;

a jet propulsion unit driven by the internal combustion engine;

an engine output control system configured to restrict the quantity of air that is taken in by the engine; and a switching means for switching the engine output control between an air-restricting state, and an unrestricting state;

whereby the maximum output of the engine is limited when the engine output control is in the air-restricting state, wherein a throttle valve opening degree is controlled by a throttle cable actuated by a throttle lever and a variable displacement mechanism controls the displacement stroke of the throttle cable so that when the engine output control is in the air-restricting state, a maximum displacement of the throttle lever results in only a partial displacement of the throttle valve.

15. A method for controlling the air intake of an internal combustion engine of a watercraft between at least first and second operation modes, the engine having an air intake regulator operable through a first range of motion corresponding with a first range of motion of a remote actuator when in the first operation mode, the method comprising:

detecting a change in a desired operation mode from the first operating mode to the second operating mode during operation of the engine; and varying the range of motion of the air intake regulator such that the air intake regulator is operable between a second range of motion that is less than the first range of motion and includes a position sufficient to cause the watercraft to reach a planing speed.

16. The method of claim 15, further comprising sensing a change in the desired operation mode from a first operation mode to a second operation mode and sending a corresponding signal to an electronic control unit.

17. The method of claim 16, further comprising controlling an electrical actuator to vary the range of motion of the air intake regulator such that it is operable between a second range of motion that is less than the first range of motion.

18. The method of claim 15, further comprising associating the first range of motion of the remote actuator with the second range of motion of the air intake regulator.

* * * * *